United States Patent [19]

Compton

[11] 4,128,358

[45] Dec. 5, 1978

[54] CONCRETE CONTROL JOINT

[76] Inventor: Marshall F. Compton, 114 Brandon, Conroe, Tex. 77301

[21] Appl. No.: 834,298

[22] Filed: Sep. 19, 1977

[51] Int. Cl.[2] ..... E04B 15/14

[52] U.S. Cl. ..... 404/47; 52/396; 52/573

[58] Field of Search ..... 52/396, 393, 573, 468; 404/47, 48, 49, 50, 67, 69

[56] References Cited

U.S. PATENT DOCUMENTS

| | | | |
|---|---|---|---|
| 429,013 | 5/1890 | Carskadon | 52/468 |
| 1,053,267 | 2/1913 | Benson et al. | 52/468 |
| 2,100,238 | 11/1937 | Burgess | 52/393 |
| 2,240,786 | 5/1941 | Kinzer | 404/69 |
| 2,245,633 | 6/1941 | Wolfe | 52/393 X |
| 2,806,414 | 9/1957 | Woodman | 404/47 X |
| 2,983,081 | 5/1961 | Brown | 52/396 |

FOREIGN PATENT DOCUMENTS

| | | | |
|---|---|---|---|
| 645364 | 7/1962 | Canada | 52/573 |
| 707212 | 6/1941 | Fed. Rep. of Germany | 404/47 |

*Primary Examiner*—Alfred C. Perham
*Attorney, Agent, or Firm*—Arnold, White & Durkee

[57] ABSTRACT

A concrete control joint is characterized by a substantially T-shaped member having a slit extending substantially vertically through the upright member of the T to define first and second leg portions thereof. The lower ends of each leg portion are resiliently and hingedly connected together. An arm of the T is connected to the end of each leg portion opposite the hinged connection. The arms terminating in fingers which extend substantially perpendicular from the underside of the arms in a direction substantially parallel to the leg portions toward the hinged joint therebetween.

3 Claims, 8 Drawing Figures

FIG. 4D
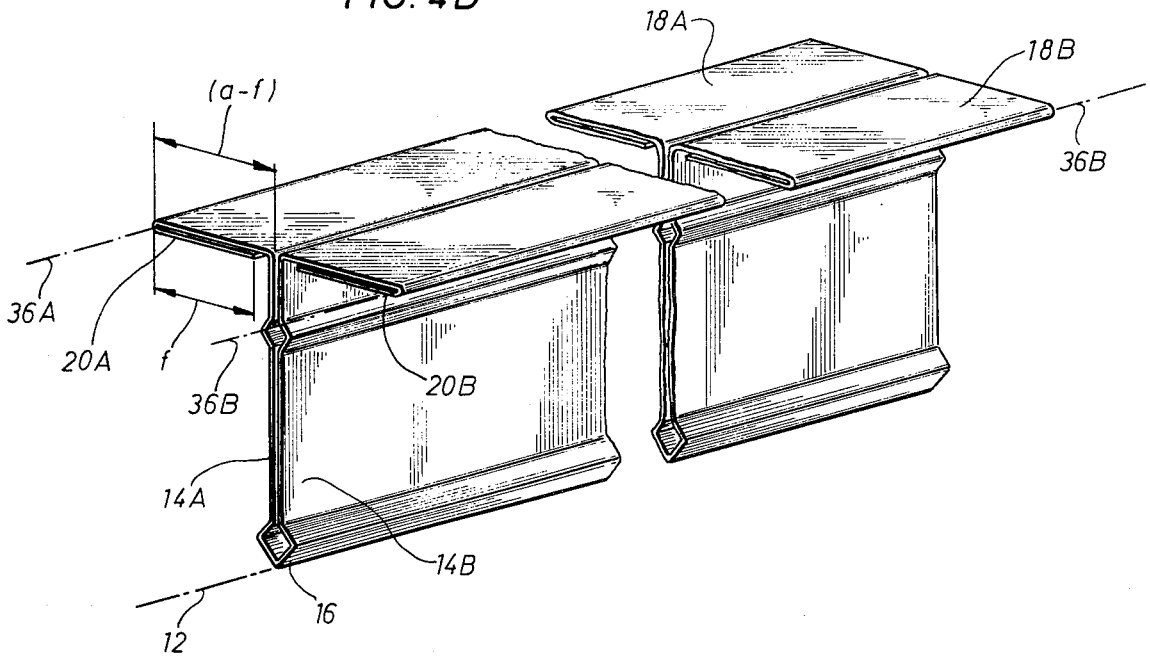
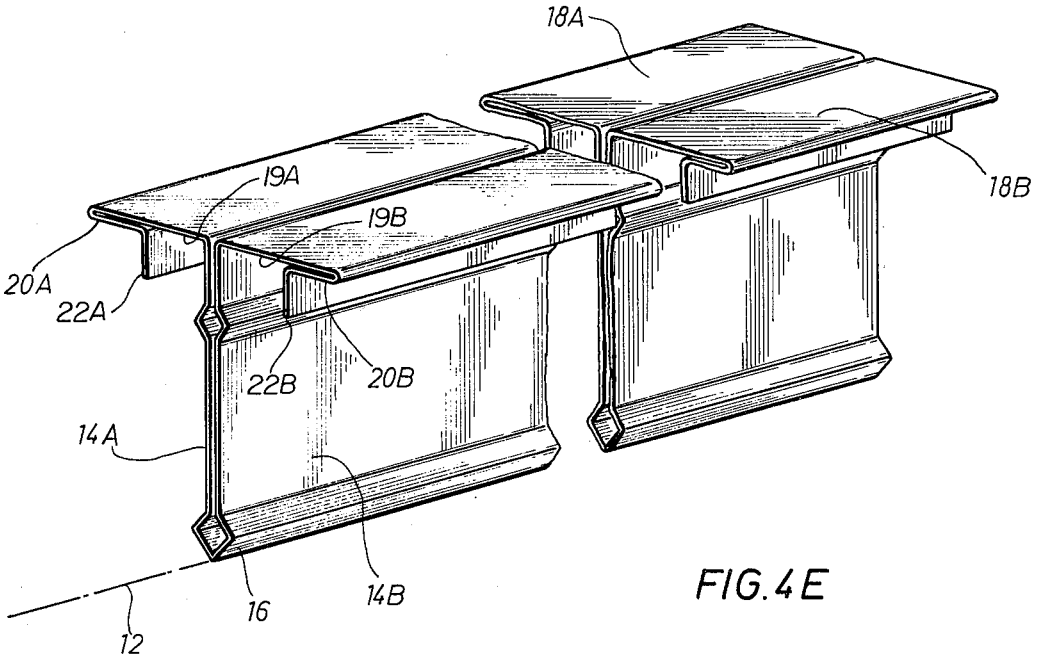
FIG. 4E

CONCRETE CONTROL JOINT

BACKGROUND OF THE INVENTION

1. Field of the Invention

This invention relates to concrete control joints, and in particular, to a structurally integral hinged control joint.

2. Description of the Prior Art

Areas of poured concrete, as highway sections or airport runway sections, have been observed to experience cracking along unpredictably locatable planes. Such cracking may occur in response to tensil forces imposed at opposite ends of the slab as, for example, at the connection therewith to the next-adjacent concrete slab.

In order to limit, or at least render predictable the locations at which cracking occurs, it is common practice in the art to artificially introduce weakened areas within the concrete slab, so that cracking which would occur would be expected along the weakened planes. For example, it is known to provide across the transverse dimension of the concrete slab at predetermined locations thereon a number of cuts extending into the concrete several inches, each cut being the width of one rotary saw blade, or approximately one-eighth of an inch. The cuts are usually displaced in some predetermined pattern in the concrete slab and any cracking of the concrete maybe expected along planes emanating from the cut.

It is also a common practice in the art to introduce substantially T-shaped plastic members transversally across a slab of concrete with the upright leg of the T extending into the concrete and the arms disposed along the surface thereof. The upright leg of the T may be viewed as a weakened plane joint and concrete cracking or fracturing may be expected to occur along that weakened plane joint.

However, in the case of either prior art expedient, once the crack occured moisture is permitted to enter through the crack into the body of the concrete slab. In the case of the saw blade cut, water accumulates in the volume defined by the cut and falls by gravity into the fissures or cracks emanating therefrom. With the case of the T-shaped plastic members, moisture seeps under the extending arms of the T-shaped member along the sides of the upright leg thereof, and into the fracture extending from the lower end of the leg. The presence of moisture within the fissures within the body of the concrete erodes the concrete, and, dependent upon climatic conditions, may expand or contract in accordance with the temperature to accelerate the deterioration of the concrete body.

It would therefore be advantageous to provide a concrete control joint fabricated of a metal material in a unitized construction such that moisture and the like is prevented from entering cracks within the concrete body emanating from the control joint. It is of further advantage to provide an integrally fabricated control joint of a hinged construction such that the hinge acts as a water stop to prohibit entry of water into the fissures generated within the concrete. It would be of yet further advantage to provide a control joint having fingers or the like adaptable to engage the edges of the concrete to secure the arms of the control joint thereto to thereby protect those edges from deterioration and erosion.

SUMMARY OF THE INVENTION

This invention relates to a concrete control joint fabricated from an integral strip of metal material. The control joint is a substantially T-shaped member with the upright leg of the T being bifurcated substantially vertically therethrough to define first and second leg portions, with the lower end of the leg portions being resiliently hinged together to permit resilient movement of the bifurcated leg portions. Each bifurcated leg portion terminates in an arm of the T, the edges of the arm being folded under to define flaps which terminate in a downwardly projecting finger or lip. The fingers or lips grippingly engage the concrete in which they are disposed so that the forces of expansion and contraction generated within the concrete are transferred through the fingers and arms to the bifurcated leg portions of the T-shaped member. The hinged construction of the T-shaped member permits resilient expansion and contraction thereof so that the structural integrity of the control joint is not breached and the joint thus effectively acts as a water stop while in place. The joint may be of any predetermined axial length consistent with the environment in which it is disposed. Thus, water seepage into the cracks or fissures generated with the body of the concrete is effectively prevented by the hinged lower portions of the bifurcated upright leg of the T-shaped member along the entire axial length of the control joint. Further, the gripping engagement of the fingers with the concrete edges maintains the arms of the T-shaped member in next-adjacency to those edges to protect the same and to prevent deterioration and erosion thereof.

BRIEF DESCRIPTION OF THE DRAWINGS

The invention will be more fully understood from the following detailed description of a preferred embodiment thereof, taken in connection with the accompanying drawings which form a part of this specification, and in which:

FIGS. 4A–4E represent a sequential diagram illustrating a method of fabricating a concrete control joint embodying the teachings of this invention.

DESCRIPTION OF THE PREFERRED EMBODIMENT

Figure 1:
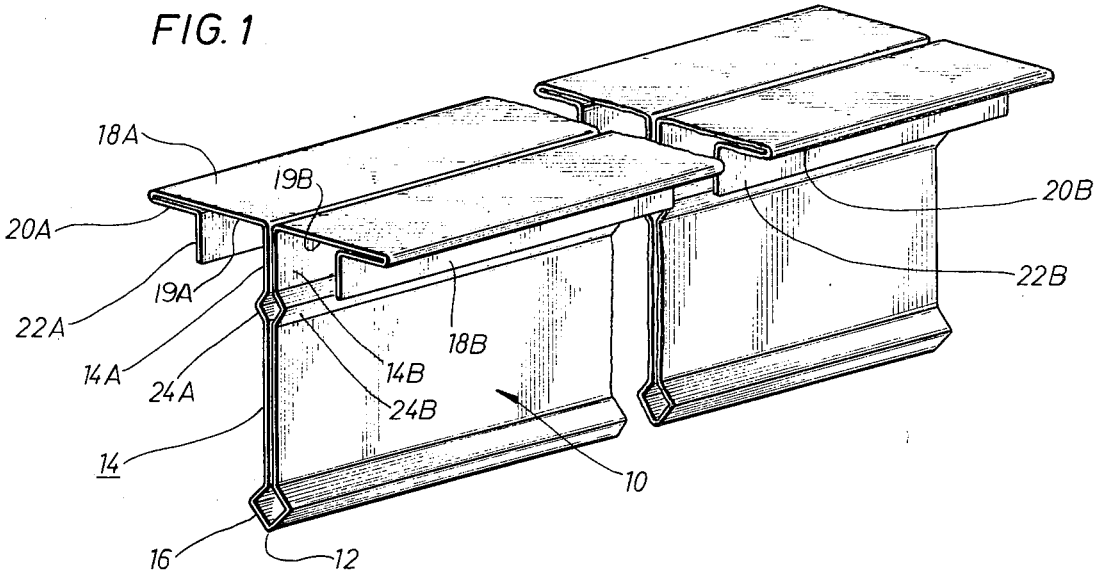
FIG. 1 is an isolated perspective view of a concrete control joint embodying the teachings of this invention.
Figure 2:
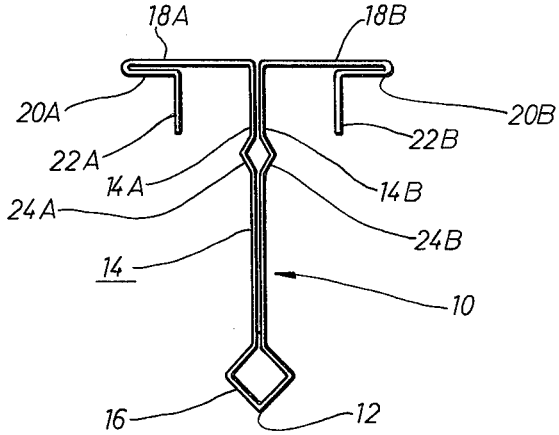
FIG. 2 is an end view, in elevation, of the control joint illustrated in FIG. 1.

Throughout the following description, similar reference numerals refer to similar elements in all figures of the drawings.

Referring to FIG. 1, an isolated perspective view of a concrete control joint embodying the teachings of this invention is shown. The control joint generally indicated by reference numeral 10 is fabricated of an integral sheet of metallic material such as rolled steel or the like and has a medial axis 12 therethrough. The thickness of the sheet of steel from which the joint 10 is fabricated is typically one-sixty fourth of an inch although material of any predetermined thickness may be utilized. Further, it is understood that the axial length of the control joint 10 measured along the medial axis 12 of the control joint may be any predetermined length dependent upon the environment in which the control joint utilized. For example, if the joint were utilized to control cracking within a highway section approximately 12 feet in transverse dimension, a control joint 10 embodying these teachings would be coextensive the the transverse dimension of the concrete section in which it is to be disposed. The medial axis 12 is defined as an axis containing a plane about which the control joint 10 is symmetrical.

The control joint 10 is a substantially T-shaped member which is split or bifurcated substantially entirely vertically through the upright leg 14 thereof. The slit extends through the upright leg 14 for the entire axial length of the control joint 10. The lower end 16 of the upright leg 14 of the T-shaped member is disposed so as to define a hinge arrangement whereby the first and second leg portions 14A and 14B are hingedly and resiliently connected one with the other. In the figures it is observed that the hinge 16 is defined by a substantially diamond-shaped distension although it is apparent to those skilled in the art that any suitable hinged connection between the leg portions 14A and 14B may be provided.

Connected to each leg portions 14A and 14B of the hingely bifurcated upright leg 14 are first and second arms 18A and 18B. It may be observed that the arms are bent so as to define a substantially 90° angle with respect to the leg portion with which they are associated. The arms 18 extend outwardly for a predetermined distance and are bent along an axis parallel to the medial axis to form a flap portion 20A and 20B which folds back and is disposed in next-adjacency to the undersurface 19 of the arms 18, that undersurface 19 being the surface of the arms 18 proximal to the hinge 16. From the extreme end of the flaps 20 are provided substantially vertically extending fingers, or lips, 22A and 22B. The fingers or lips 22 extend substantially perpendicularly to the flaps 20 and substantially parallel to the leg portion 14 of the hingedly bifurcated upright leg of the T-shaped member with which they are associated.

Each leg portion 14A and 14B may be provided with a hump 24. The hump portion 24 is provided adjacent the axial ends of the control joint 10 for the purpose of axial registration with the hump portions of the next-adjacent control joint so that, if desired, adjacent control joints may be connected one with the other. For this purpose, suitable connecting pins may be inserted into the openings defined between the humps of one control joint and then inserted into the opening defined between the humps of the other control joint.

Figure 3:
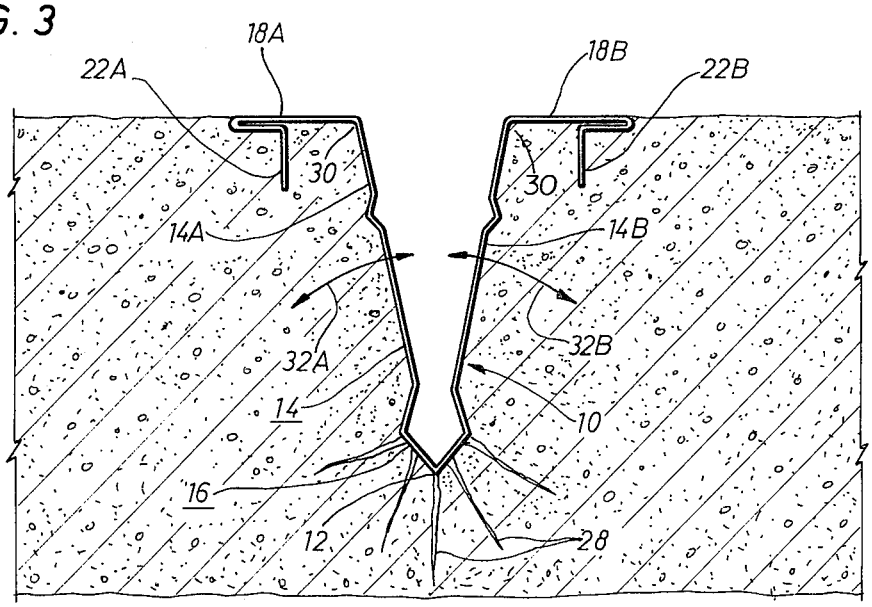
FIG. 3 is an elevational view in vertical section through a concrete block having a control joint embodying the teachings of this invention disposed therein.

With reference to FIG. 3, a control joint 10 embodying the teachings of this invention is shown disposed within a body of concrete material. The control joint 10, when inserted, defines a weakened plane joint within the body of the concrete material such that any cracks of fissures which tend to occur within the concrete (being illustrated diagrammatically at reference numeral 28) tend to be created adjacent the lower end of the upright leg 14 of the control joint 10. The control joint 10 is set into the concrete while in an unhardened state such that the fingers or lips 22 grippingly engage the concrete adjacent edge portions 30 defined therein. It may be appreciated that the edges 30 of the concrete body are overlapped and protected by the under-surfaces 19 of the arms 18 of the T-shaped control joint 10 to thus prevent erosion or deterioration thereof.

It may further be appreciated with reference to FIG. 3 that as the concrete expands and contracts in response to temperature and other environment conditions, the leg portions 14A and 14B are resiliently moveable in directions indicated by references arrows 32 from the hinged joint 16 provided at the lower ends of each of the leg portions 14A and 14B. Therefore, the structural integrity of the control joint 10 embodying the teachings of this invention is maintained throughout the expansions and contractions of the concrete in which it is disposed. Since, an effective water stop is provided by the hinged connection 16 disposed integral with the lower end of the leg portions 14A and 14B, moisture is prohibited from entering into the cracks 28 generated within the concrete body.

Figure 4A:
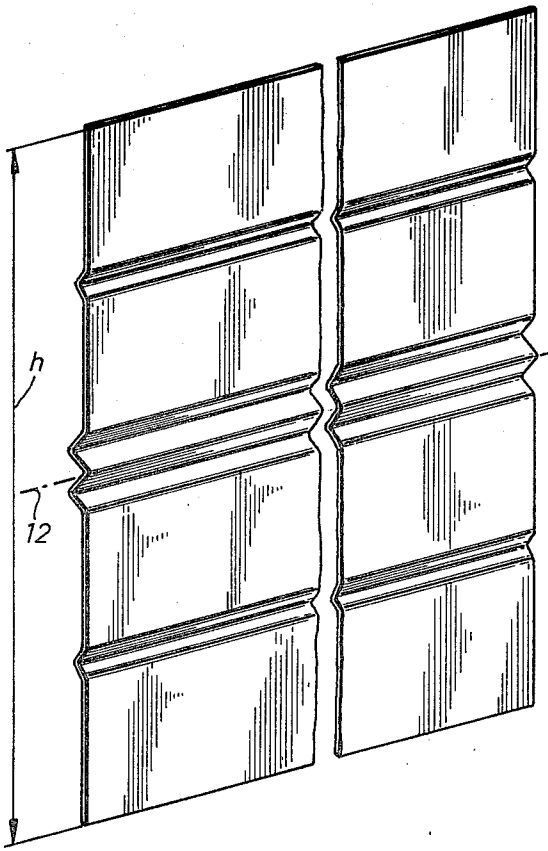
Figure 4B:
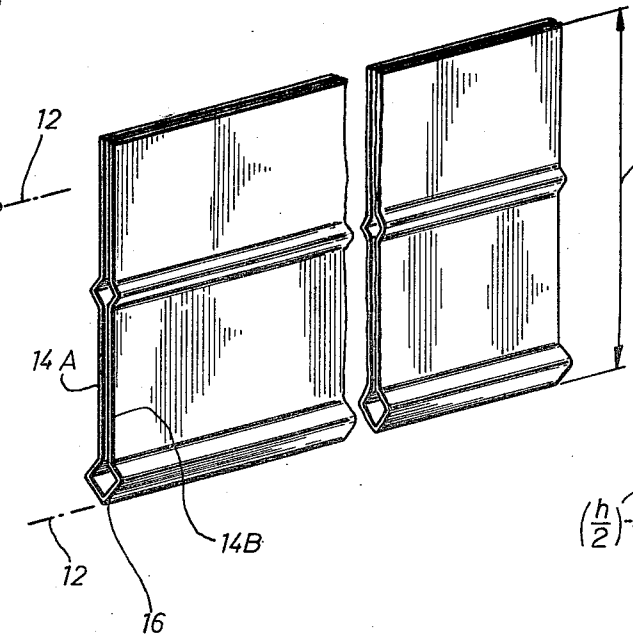
Figure 4C:
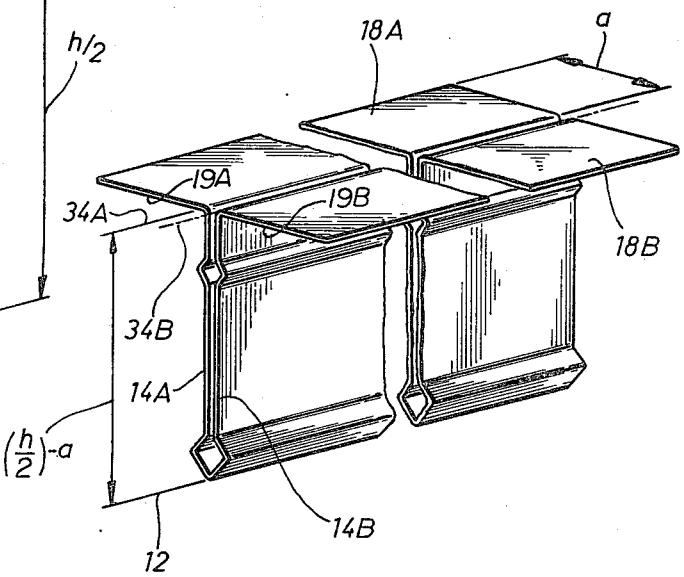

Referring to FIGS. 4A through 4E, a method of fabricating a concrete control joint in accordance with the teachings of this invention is diagrammatically illustrated. As discussed above, the control joint 10 embodying these teachings is fabricated from an integral sheet of metallic material. The first step in the method is to fold the integral sheet along the medial axis 12 therethrough so as to define first and second leg portions 14A and 14B (FIG. 4B) extending substantially parallel to each other. The fold along the medial axial 12 is observed to define a hinge 16 between the lower termini of the leg portion 14A and 14B. If desired, the hinged portion 16 may be suitably configured, as in a diamond or circular shape, to facilitate resilient bending of the leg portions. Further, each leg portion 14 may be bent to define a hump 24 therein, if desired. In general, however, it is necessary only that the leg portions 14 be hingedly connected at their lower ends. With reference to FIG. 4C, the next step is to bend each leg 14A and 14B along an axis parallel to and equidistant from the medial axis 12 to form arms 18A and 18B projecting outwardly from each leg portion 14A and 14B at an angle substantially 90° with respect to the leg portions 14. As viewed in FIG. 4D, this operation defines a substantially T-shaped member which is split or bifurcated substantially entirely through the upright leg thereof but still provides hinged connection between the lower ends of each portion of the leg.

With reference to FIG. 4D, each of the arms 18 is folded along an axis 36 parallel to the medial axis 12 to define the flaps 20 which extend parallel to and next-adjacent the undersurfaces 19 of the arms 18 proximal to the fold or hinge 16 which defines the leg portions 14A and 14B. Finally, each flap 20 is bent along an axis 38 parallel to the medial axis 12 to thereby define a finger, or lip, 22 extending substantially 90° with respect to the flap 20 with which it is associated.

It may be appreciated by those skilled in the art that a concrete control joint embodying the teachings of this invention provides a member suitable for controlling cracks or fissures within a concrete body in accordance with the conventional teachings in the art. Furthermore, however, the control joint embodying the teachings of this invention, through the provisiion of the bifurcated upright leg of the T-shaped member connected hingedly at the lower ends thereof, and the disposition of fingers 22 in the concrete body with which the joint 10 is associated, provides an effective water stop to prevent the entry of water into the cracks or fissures generated into the concrete body and also provides suitable protection for the edges of the concrete to prevent erosion or deterioration thereof. It is again noted that the control joint may be of any predetermined dimension dependent upon the environment in which it is disposed.

Having defined a preferred embodiment of the invention, modifications may be made thereto in view of the teachings disclosed herein by those with skill in the art. It is understood, however, that such modifications remain within the contemplation of this invention as defined in the appended claims.

What is claimed is:

1. A concrete control joint fabricated of integral metallic stock comprising a substantially T-shaped member wherein the upright leg of the T is split substantially entirely along a plane extending vertically therethrough to thereby define first and second leg portions hingedly connected at the lower ends thereof, each of the leg portions having an arm connected thereto, a portion of each arm being folded beneath itself toward the leg portion with which it is associated to define a flap disposed adjacent to the undersurface of each arm, each flap having a finger extending substantially perpendicularly to the underside surface of the arm toward the lower hinged termini of the leg portions, each finger being spaced inwardly from the end of each arm toward the leg portion with which the arm is associated.

2. A method for fabricating a concrete control joint comprising the steps of:

folding an integral metal sheet along the medial axis thereof to form first and second leg portions extending substantially parallel to each other;

bending each leg portion along an axis parallel to and equidistant from the medial axis to form each leg portion at an angle of approximately 90° with respect thereto to thereby define a substantially T-shaped member;

folding each arm along an axis parallel to said medial axis to define a flap extending parallel to and next-adjacent the surface of the arm proximal to the fold defining said leg portion; and, bending each flap along an axis parallel to said medial axis to define a finger extending perpendicularly to the flap with which it is associated.

3. A concrete control joint made by the method of claim 2.

* * * * *